United States Patent [19]

Wenander

[11] 4,203,714

[45] May 20, 1980

[54] APPARATUS FOR VACUUM PROCESSING OF CONCRETE

[75] Inventor: Harald S. Wenander, Nacka, Sweden

[73] Assignee: Tremix AB, Skarholmen, Sweden

[21] Appl. No.: 689,413

[22] Filed: May 24, 1976

[30] Foreign Application Priority Data

May 30, 1975 [SE] Sweden ..... 7562224

[51] Int. Cl.[2] ..... B28B 11/00

[52] U.S. Cl. ..... 425/85; 425/445

[58] Field of Search ..... 249/141; 425/84, 85, 425/812, 445; 264/86, 87, 101

[56] References Cited

U.S. PATENT DOCUMENTS

| | | | |
|---|---|---|---|
| 2,046,867 | 7/1936 | Billner | 264/87 |
| 2,533,263 | 12/1950 | Johnson | 425/85 |
| 3,021,254 | 2/1962 | Helversen et al. | 425/812 |
| 3,506,747 | 4/1970 | Creskoff | 264/101 |
| 3,514,857 | 6/1970 | Rossen | 425/84 |
| 3,600,771 | 8/1971 | Dyrander | 425/85 |

*Primary Examiner*—John McQuade

*Attorney, Agent, or Firm*—Sughrue, Rothwell, Mion, Zinn and Macpeak

[57] ABSTRACT

This invention relates to apparatus for vacuum processing concrete for removing surplus water from the concrete by exposing the concrete to vacuum. According to the invention solid particles are prevented from being sucked away from the concrete by applying the vacuum to the concrete surface through a sheet perforated with a great number of holes. The holes are sized to substantially exceed the smallest particles to be prevented from being sucked away by filtering within the concrete.

4 Claims, 3 Drawing Figures

APPARATUS FOR VACUUM PROCESSING OF CONCRETE

Figure 1:
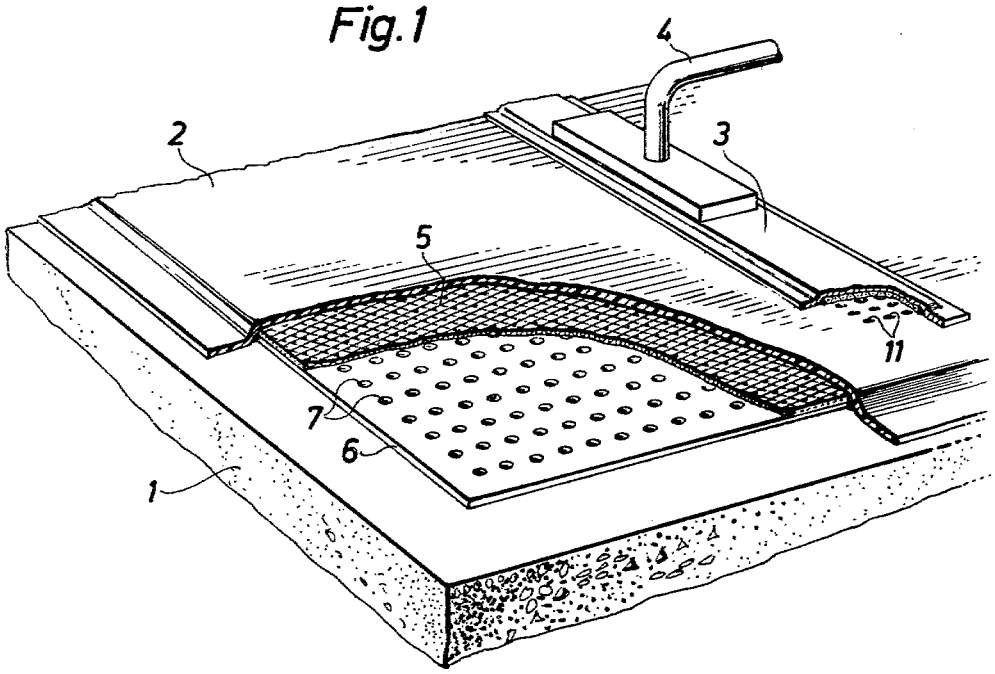

This invention relates to apparatus for vacuum processing concrete for removing surplus water from the concrete by exposing the concrete to vacuum.

Vacuum processing of concrete is a well-known technique for removing the surplus water, which is required in the concrete to allow the concrete to be conveniently transported and handled, but is not required for the chemical reactions which take place when the concrete is setting. The surplus water is squeezed out of the concrete by producing a vacuum within the concrete and simultaneously allowing the atmospheric pressure to act on the concrete.

Known arrangements for effectuating this usually comprise an upper flexible cover provided with connection means to a vacuum source for defining a surface to be processed, a filter cloth to be placed on the concrete surface in order to prevent cement and other solid particles from following along with the water being removed from the concrete, and a distance means, usually in the form of a distance net, which is disposed between the upper cover and the filter cloth to form passages for transport of the water removed from the concrete and to uniformly distribute the vacuum over the concrete surface. During the course of a treatment the upper cover must entirely cover the distance means and filter cloth, and its edge portions must sealingly contact the concrete surface.

In order to improve the flexibility of such an arrangement, the distance net usually is manufactured in sections, to which filter clothes are attached and which are to be laid out adjacent each other with overlapping edge portions. One disadvantage among others of this arrangement is that the attachment of the filter clothes to the distance net sections is a relatively tedious and expensive operation. The utilization of distance nets, moreover, involves certain problems, because it is difficult to manufacture the nets so that they will lie plane on the surface on which they are placed. The reason thereof is that the edge portions of the nets usually have a slightly greater length than the central portion, which can give rise to impressions of the distance nets in the newly poured concrete during the action of the atmospheric pressure.

A main object of the present invention is to provide an apparatus, by which among others the vacuum processing of concrete is simplified and the aforesaid disadvantages are eliminated.

The invention is based on experiments, which surprisingly have proved that filter clothes, which usually consist of a very close-meshed nylon cloth, can be replaced by a cloth or sheet with small perforation holes, which, however, are substantially greater than the smallest particles to be prevented from being sucked along from the concrete. The good filtering effect achieved by perforated sheets of this kind probably is due to the fact, that as the sucking action resulting from the vacuum is applied to the concrete surface at mutually spaced points a filtering structure is built up in the concrete within the range of each such point. It seems to be the smaller particles in the concrete which are stopped on their way towards the points at which the vacuum is applied and which particles together form a filtering structure. It has been found, as a matter of fact, that when the suction mat is placed on a wet concrete surface and the vacuum source is connected first a small amount of water is obtained which is mixed with small cement particles, and that thereafter the water subsequently sucked cut of the concrete is substantially clear. As an example can be mentioned that the smallest cement particles here concerned are of the size of a few microns while the hole size can be of the order of 1 mm. The spacings between the holes can be varied within relatively wide intervals, but good results have been obtained by using hole patterns with a spacing of 5–25 mm.

As the filter cloth in prior art apparatuses can be replaced by a cloth or sheet, the structure of the combined filtering and distance section is facilitated to a high degree, because a sheet can relatively simply be attached to a distance net. The invention, further, renders it possible to eliminate the distance net and, instead, to arrange elevations of top or ridge configuration on the perforated sheet, which elevations upon application of the upper cover form between themselves the necessary passages.

Figure 2:
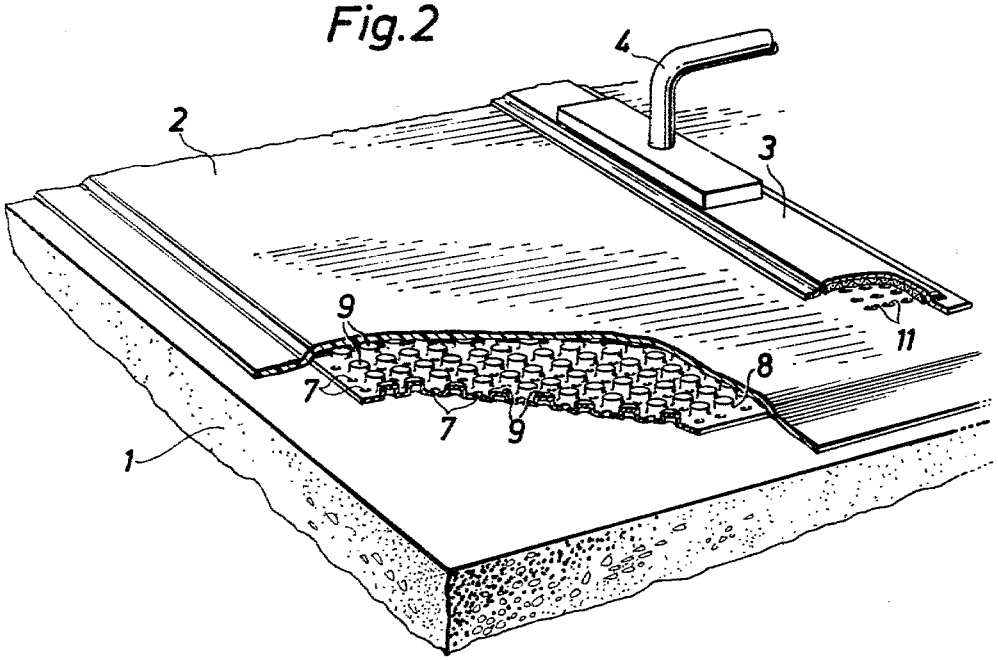
Figure 3:
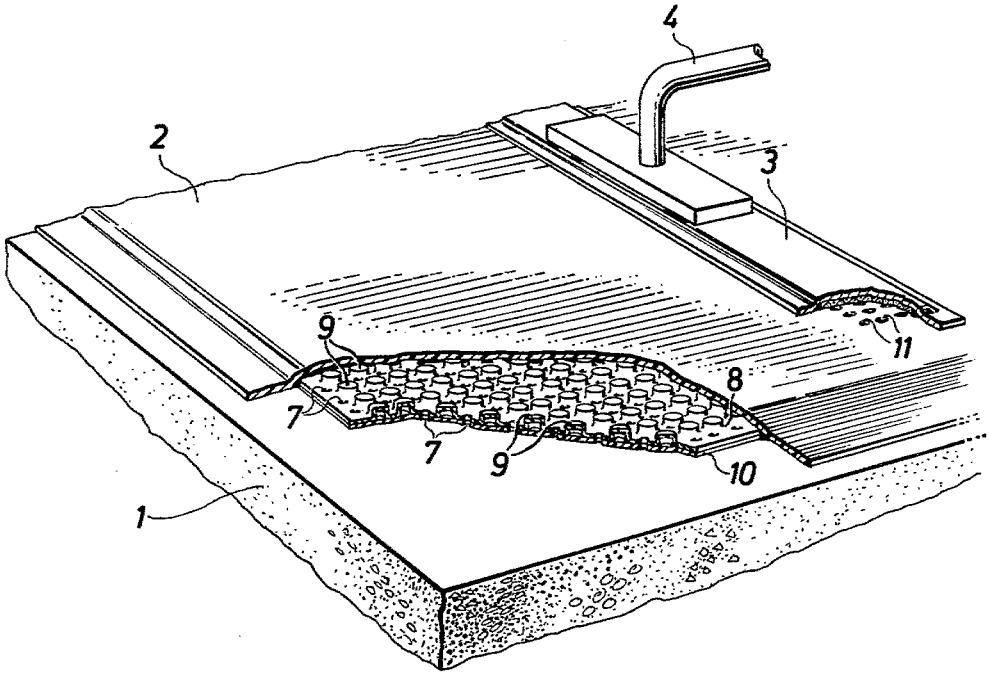

The invention is described in greater detail in the following, with reference to the accompanying schematic drawing, in which the FIGS. 1–3 are three different embodiments of an apparatus according to the invention applied to a concrete surface and with certain portions cut away.

Referring now to FIG. 1, the reference numeral 1 designates a concrete surface to be vacuum treated. For this purpose a flexible upper cover 2 is placed over the surface in order to sealingly define a portion thereof from the ambient air. A suction box 3 of known design extends over the entire length of the cover 2. Said suction box communicates with holes 11 in the cover 2 and is provided with means 4 for connection to a vacuum source (not shown) and has for its object to evacuate the space under the cover 2 and to carry away the water removed from the concrete.

In the embodiment according to FIG. 1 a distance net 5 is provided beneath the cover 2 to form passages for conducting away water removed from the concrete and for uniformly distributing the vacuum over the entire surface being processed. In order to prevent cement particles and other solid particles form being sucked away along with the water removed from the concrete, a lower cloth or sheet 6 is provided between the distance net 5 and concrete surface 1. Said sheet 6 is provided with a plurality of small holes 7, which, however, in size substantially exceed the smallest particles to be prevented from being sucked away from the concrete. Due to said holes 7, the suction action obtained by the vacuum under cover 2 is applied to the concrete surface 1 at mutually spaced points. This implies among others that the water to pass through the holes 7 must pass through a shorter or longer distance in the concrete 1. This has proved to result in the formation of natural filtering structures in the concrete along the passage ways of the water towards the holes 7 in the sheet 6. These structures, according to above, seem to be built up of cement particles, which are stopped on their way ahead to the place of a hole 7 in the sheet 6. During experiments, the spacings between the holes 7 have been between 5–25 mm, and the hole diameter was 1–1.5 mm. This lastmentioned size is to be compared with the size of some few microns of the smallest cement particles. However, neither the dimension nor the spacing of the holes, seem to be critical but can be chosen according to desire.

The perforated sheet 6 and the distance net 5 are assembled to form one unit. These units are manufactured in sections, although this is not apparent from the Figures, and positioned to the side of each other with overlapping edge portions.

In FIG. 2 a highly advantageous embodiment is shown, in which the distance net 5 and sheet 6 according to FIG. 1 are replaced by a single cloth or sheet 8, which by embossing or a corresponding method is provided with elevations 9. These elevations, which may have the configuration of tops or ridge formations broken at certain intervals, act as distance means, by which upon the attachment of the upper cover 2 transport passages are formed under said cover. Like sheet 6 in FIG. 1, also sheet 8 is provided with a plurality of small holes 7, which mainly are located in those portions between the elevations 9 which abut the concrete surface 1. The holes 7, however, can be distributed substantially at random over the sheet 8, as long as not many of the holes are located accurately on the tops of the elevations 9, because they then would be closed by the cover 2. In this embodiment, thus, both the necessary passages under the cover 2 and the filtering effect with respect to solid particles are obtained by one and the same sheet 8, which to a high degree renders the apparatus and its handling cheaper and simpler.

According to FIG. 3, the sheet 8 in FIG. 2 has been assembled with a plane lower cloth or sheet 10 thereby increasing the bearing surface against the concrete 1. The two sheets 8 and 10 are provided with aligning holes 7 whereby the filtering based on the aforesaid effect is maintained. The same effect as in FIG. 3, of course, also is obtained when only a single sheet is used, at which the elevations are not brought about by embossing but in another way, for instance by adding additional material to a plane sheet.

The invention can also in other respects be varied in several respects within the scope of the claims. The means 2, 8 and 10 for instance may be flexible clothes or rigid plates. The word "sheet" is used as a comprehensive term for both types of means. The essential feature is that the necessary filtering is effected by applying the vacuum and thus the sucking action to the concrete surface at a plurality of spaced points, for example, through a plurality of holes distributed over the surface in a cloth or sheet.

What is claimed:

1. An apparatus for vacuum processing concrete to remove surplus water from a concrete surface comprising: an upper cover for sealingly defining a surface to be processed, a vacuum source, means for connecting said vacuum source to said cover, lower sheet means preventing solid particles from being sucked away from the concrete surface along with the water, and means forming passages between the upper cover and said lower sheet means for distribution of the vacuum from said vacuum source and transport of the water removed from the concrete, said lower sheet means having perforations comprising small holes the size of which substantially exceeds the smallest size of the particles of concrete.

2. An apparatus according to claim 1, wherein said lower sheet means is provided with elevations serving as a spacer.

3. An apparatus according to claim 2, wherein the elevations are bosses of the material of the lower sheet means and said holes substantially are located in the positions between said bosses.

4. An apparatus according to claim 3, wherein the lower sheet means provided with bosses is placed on a plane sheet and the holes extend through both said plane sheet and said lower sheet means.

* * * * *